United States Patent [19]

Holce et al.

[11] Patent Number: 4,525,018

[45] Date of Patent: Jun. 25, 1985

[54] MODULAR TERMINAL HOUSING

[75] Inventors: Thomas J. Holce, Portland; Charles M. Huckins, Tigard, both of Oreg.

[73] Assignee: Sentrol, Inc., Portland, Oreg.

[21] Appl. No.: 621,112

[22] Filed: Jun. 15, 1984

[51] Int. Cl.[3] ..... H01R 13/502

[52] U.S. Cl. ..... 339/91 R; 339/154 A; 339/213 R

[58] Field of Search ..... 339/91 R, 147 C, 198 R, 339/198 C, 198 J, 198 P, 201, 202, 203, 206 R, 213 R, 213 S, 213 T, 191 R, 191 A, 191 M, 192 R, 192 RL, 193 R, 193 N, 193 VS, 194 R, 194 N, 196 R, 196 A, 196 M, 154 R, 154 A

[56] References Cited

U.S. PATENT DOCUMENTS

| | | | |
|---|---|---|---|
| 2,946,977 | 7/1960 | Sheldon | 339/191 R |
| 2,989,722 | 6/1961 | O'Donnell | 339/191 R |
| 3,253,252 | 5/1966 | Piperato | 339/198 P |
| 3,601,699 | 8/1971 | Norton, Jr. et al. | 339/193 VS |
| 3,688,244 | 8/1972 | Savoca et al. | 339/154 A |
| 3,689,868 | 9/1972 | Snyder | 339/147 C |
| 4,096,352 | 6/1978 | von Zweck | 339/198 C |
| 4,213,110 | 7/1980 | Holce | 335/207 |

*Primary Examiner*—John McQuade

*Attorney, Agent, or Firm*—Chernoff, Vilhauer, McClung, Birdwell & Stenzel

[57] ABSTRACT

A housing for a magnetic reed switch or other electrical component is housed in a compact cylindrical housing. A screw type terminal strip having recessed openings for the insertion of wires is mated to the cylindrical housing by an adapter having snap lugs for engaging flange portions in the recessed openings on one side, and a circular retainer on the other. A tab on the housing cooperates with a slot on the adapter to prevent rotation.

4 Claims, 7 Drawing Figures

10
12
14a
14b
16
18
20
22
24
24a
24b
26a
26b
28
29a
29b
30a
30b
32a
32b
34a
34b
36a
36b
38a
38b
40a
40b
40c
40d
5
6

MODULAR TERMINAL HOUSING

BACKGROUND OF THE INVENTION

The present invention relates to a screw-actuated wire terminal joined to a cylindrical housing containing electrical or electronic components by a disk-shaped adapter.

Home security systems frequently have a plurality of remote sensing devices connected to a central control circuit. These remote sensing devices may take the form of magnetic reed switches, moisture detectors, or acoustic detectors but all are generally small devices which are designed to fit into tight locations or into bores drilled in walls or window sills where space is at a premium. To that end, housings have generally been provided for such devices which are cylindrical in nature and occupy relatively small dimensions. An example of such a device is shown in the Holce U.S. Pat. No. 4,213,110. FIGS. 4 and 5 of that patent disclose a cylindrical housing for a magnetic reed switch which is intended to be inserted into a bore drilled through a door or window sill. The housing of the Holce patent suffers from the problem however, that the leads connecting the magnetic reed switch to the security system are more or less permanently attached to the contacts of the reed switch. If the reed switch must be replaced, there is no convenient way to disconnect the switch from the rest of the circuit other than by cutting the wires. Once the wires are cut, however, the only way to connect a new reed switch to the circuit is to twist the wires in pigtail fashion to a pair of leads connected to the ends of the magnetic reed switch inside the housing. This type of connection is, however, prone to failure.

Although it is possible to terminate the reed switch contacts in a pair of screw-type binding posts mounted on one end of the cylindrical housing, these posts must usually be set too close together, given the size of the housing, for reliable performance. Typically, short circuits will occur when a strand of wire from one binding post touches the other. This is a frequent problem after the wires have been connected and the device is being physically installed or manipulated to place it in some tight location.

Modular screw-type wire terminal connectors and terminal strips which do not suffer from the above noted deficiencies have been available for a variety of applications. An example of such a connector is marketed under the trademarks "WIBA" and "ELECTROVERT." These terminal strips, however, have a generally rectangular base and are ill suited for connection to a reed switch or for any component enclosed in an essentially cylindrical housing.

What is needed, therefore, is an integral housing consisting of a tubular holder for a magnetic reed switch or the like, with a means of affixing thereto a modular terminal strip in a secure yet inexpensive, cost-effective fashion which can be easily manufactured and assembled.

SUMMARY OF THE INVENTION

The present invention overcomes these and other problems by providing a connector capable of mating the essentially tubular cross-section of the magnetic reed switch housing with the essentially rectangular cross-section of the modular terminal strip.

According to the present invention, the cylindrical housing which has a tab is adapted to mate with a generally disk-shaped adapter having a slot for mating with the tab. The adapter includes a semicircular stop on one side thereof, having an outer radius slightly less than the inner radius of the tubular housing. This stop prevents the adapter from moving laterally with respect to the housing, and the tab and slot alignment prevents the adapter from moving rotationally with respect to the housing. The adapter is designed to mate on its other side with a terminal strip. The terminal strip has a pair of pins which protrude through holes in the adapter to the inside of the housing. Inside the housing the pins may be connected to the appropriate contacts of a switch or other component included in the housing. In order to affix the terminal strip to the adapter, a set of upright tabs is provided which are arranged to form a rectangle of just slightly larger dimension than the rectangular bottom of the terminal strip. In addition, a pair of snap lugs are provided on the adapter which each engage a pair of flanges formed at the bottom of lateral recesses on the terminal strip. Inside the recesses are screw-actuated wire termination contacts.

The resulting combination is a modular integrated housing of compact size, having improved wire connecting capability and which can be removed from a security system for repair or replacement without cutting the wire leads.

It is a primary object of this invention to provide a small modular switch or component housing which may be wired to a security system using conventional screw type terminal connectors.

It is another object of this invention to provide an inexpensive and easily assembled integrated housing and connector terminal in security systems or the like.

Yet a further object of this invention is to provide an integral housing and terminal strip for use in a security system which can be easily installed and/or replaced.

The foregoing and other objectives, features and advantages of the present invention will be more readily understood upon consideration of the following detailed description of the invention taken in conjunction with the accompanying drawings.

DETAILED DESCRIPTION OF THE INVENTION

Figures 1, 2, 3, 4, 5, 6, 7:
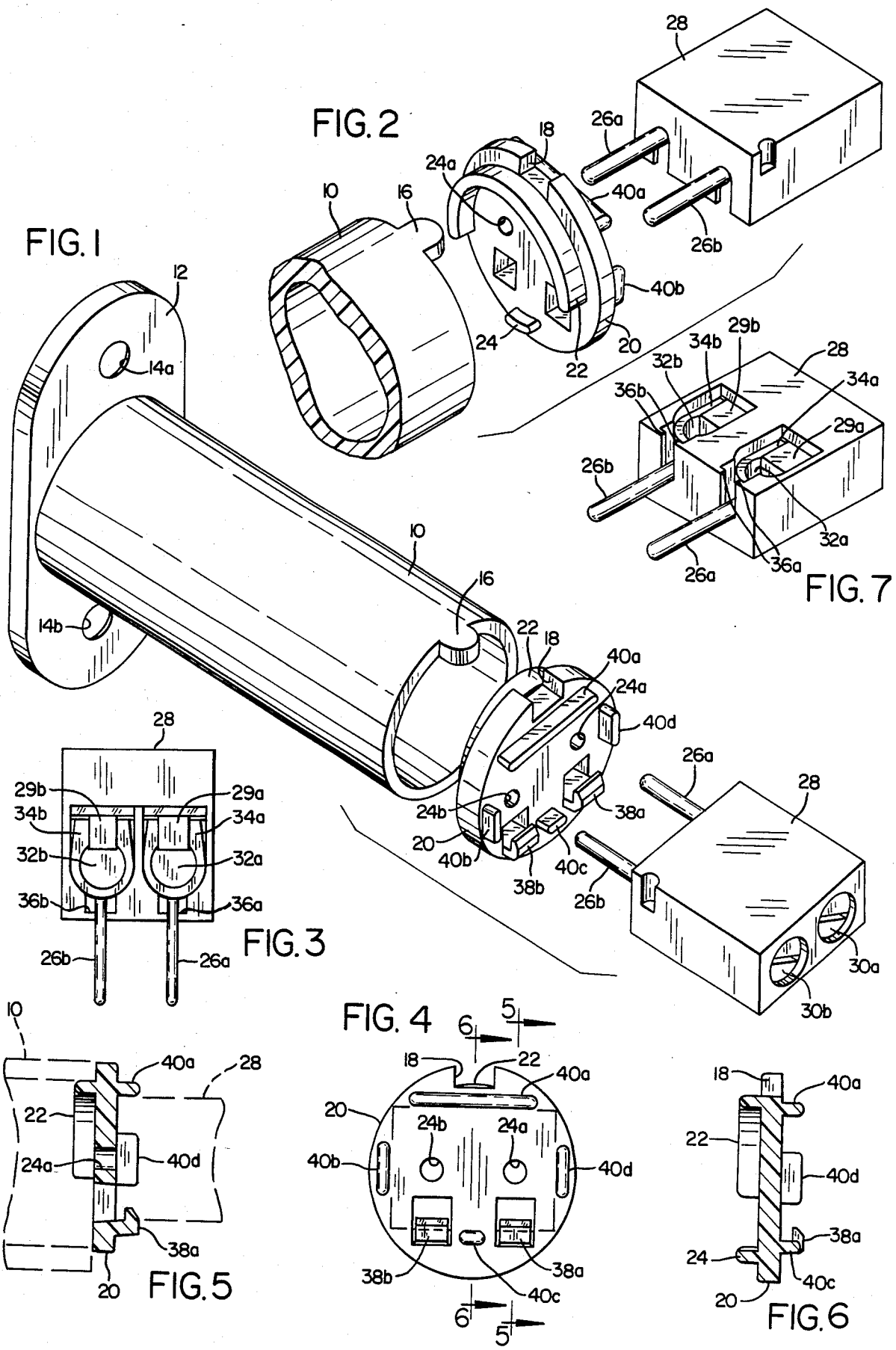
FIG. 1 is an exploded perspective view of a housing for electrical circuit components embodying the present invention.
FIG. 2 is a partial exploded perspective view of the housing of FIG. 1 viewed from a different angle.
FIG. 3 is a front view of a modular terminal strip for use with the present invention.
FIG. 4 is a top view of a adapter plate for use with the present invention showing the modular terminal strip in phantom line.
FIG. 5 is a sectional view taken along line 5—5 of FIG. 4 showing a tubular housing and modular terminal strip in phantom line.
FIG. 6 is a sectional view of the adapter taken along line 6—6 of FIG. 4.
FIG. 7 is a perspective view of modular terminal strip shown in FIG. 3.

A cylindrical housing 10 has an integral base 12 with mounting apertures 14*a* and 14*b*. These apertures may receive any suitable fastener such as a screw (not shown) for mounting the device to a wall, door, windowsill or the like. The cylindrical housing 10 has a tab 16 which mates with a slot 18 in adapter 20.

Referring now to FIG. 2, adapter plate 20 has a downwardly-extending semicircular retainer 22 having a radius slightly smaller than the inner radius of cylindrical housing 10. An arcuate retainer 24 is arranged to lie generally opposite retainer 22 but has the same radius of curvature and fits just inside the tubular housing 10. The semicircular retainer 22 with arcuate retainer 24 keeps the adapter 20 from moving laterally with respect to the cylindrical housing 10. The tab 16 cooperates with slot 18 to prevent the adapter from rotating.

The adapter 20 includes a pair of holes 24*a* and 24*b*, which receive a pair of pins 26*a* and 26*b* on a screw-actuated terminal strip 28. Terminal strip 28 may be, for example, a modular terminal strip marketed under the "Electrovert" trade name and the WIBA trademark. Model 8181/2 in this product line is an example of a type of terminal strip suitable for use in this application.

The terminal strip 28 includes a pair of screws 30*a* and 30*b*. Each of these screws presses against each of a pair of deformable tongues 29*a* and 29*b*, respectively. A pair of lateral openings 32*a* and 32*b* include a pair of U-shaped wire contacts 34*a* and 34*b* and the tongues 29*a* and 29*b* frictionally clamp wires inserted through openings 32 against the U-shaped contacts 34*a* and 34*b*.

Openings 32 provide an efficient means for fastening the terminal strip 28 to the adapter 20. The openings 32 create narrow flanges 36*a* and 36*b* which extend in a laterally inward direction from the side face of the terminal strip towards pins 26*a* and 26*b*. These flanges may be engaged by a pair of snap lugs 38*a* and 38*b* located on adapter 20. Further support for the terminal strip 28 is provided by a set of upright tabs 40*a*, 40*b*, 40*c* and 40*d*. The upright tabs 40 together with snap lugs 38 are arranged in a generally rectangular pattern whose dimensions are just slightly larger than the cross-sectional rectangular dimensions of the terminal strip 28. Thus, the terminal strip may simply be press fitted onto the adapter 20 and the snap lugs 38 will engage the flanges 36. The dimensions of the lugs 40 may be arranged so as to define a rectangle of substantially the same cross-sectional area as terminal strip 28 so as to provide a tighter fit. Likewise, the circular retainers 22 and 24 can be dimensioned so as to cause adapter 20 to snugly engage housing 10. In such a case the entire assembly could be press fitted together and no glue or other adhesives would be necessary. Furthermore, due to the modular nature of its construction, the housing or any electrical component therein may be replaced or repaired independent of the terminal strip 28. This has not been possible in the past since failures in the housing usually dictated that the entire unit be thrown away and replaced.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A modular housing and terminal for an electrical component comprising:

(a) a terminal strip having a substantially rectangular base;

(b) a substantially cylindrical housing for an electrical component; and (c) adapter means for connecting said terminal strip to said housing, said means having two sides, one side including rectangular retaining means for engaging said terminal strip, and the other side including arcuate retaining means for engaging said housing.

2. The modular housing and terminal of claim 1 wherein said terminal strip has at least one lateral opening therein forming a flange and said adapter means includes means for detachably engaging said flange.

3. The modular housing and terminal of claim 2 wherein said arcuate retaining means includes an upright snap lug that protrudes into said opening and engages said flange.

4. The modular housing and terminal of claim 3, further including tab-and-slot means associated with said housing and said adapter means for preventing rotation of said housing with respect to said adapter means.

* * * * *